US007331145B2

(12) United States Patent
Feucht et al.

(10) Patent No.: US 7,331,145 B2
(45) Date of Patent: Feb. 19, 2008

(54) FLASHING COMPONENT FOR A ROOF WINDOW ASSEMBLY

(75) Inventors: Mark Albert Feucht, Greenwood, SC (US); Samuel Howard Darmer, Greenwood, SC (US); Jeffrey Joseph Ronan, Greenwood, SC (US); Elizabeth Ferol Talcott, Greenwood, SC (US); Gregory Foster Collins, Greenwood, SC (US); Claes Lindgren, Farum (DK); Kaj Nissen, Virum (DK)

(73) Assignee: VKR Holding A/S, Søborg (DK)

( * ) Notice: Subject to any disclaimer, the term of this patent is extended or adjusted under 35 U.S.C. 154(b) by 742 days.

(21) Appl. No.: 10/691,974

(22) Filed: Oct. 24, 2003

(65) Prior Publication Data

US 2004/0139669 A1 Jul. 22, 2004

Related U.S. Application Data

(63) Continuation-in-part of application No. 09/803,669, filed on Mar. 12, 2001, now Pat. No. 6,640,508.

(30) Foreign Application Priority Data

Jan. 19, 2001 (DK) ..... 2001 00105

(51) Int. Cl.
*E04D 13/14* (2006.01)
*E04B 1/38* (2006.01)
*E04B 5/00* (2006.01)

(52) U.S. Cl. ..... 52/58; 52/200; 52/409

(58) Field of Classification Search ..... 52/58, 52/60, 200, 408, 409, 94, 95
See application file for complete search history.

(56) References Cited

U.S. PATENT DOCUMENTS

| | | | | | |
|---|---|---|---|---|---|
| 1,685,525 | A | * | 9/1928 | Dow | 52/58 |
| 3,256,650 | A | * | 6/1966 | Weckerly et al. | 52/58 |
| 4,073,097 | A | | 2/1978 | Jentoft et al. | |
| 4,570,394 | A | | 2/1986 | Jentoft et al. | |
| 4,776,141 | A | | 10/1988 | Powell | |
| 4,972,638 | A | * | 11/1990 | Minter | 52/200 |
| 5,018,333 | A | * | 5/1991 | Bruhm | 52/741.4 |
| 5,150,983 | A | | 9/1992 | Bogenhagen | |
| 5,199,234 | A | | 4/1993 | Guhl | |
| 5,522,189 | A | * | 6/1996 | Mortensen et al. | 52/200 |
| 5,544,455 | A | | 8/1996 | Deblock | |
| 5,605,020 | A | * | 2/1997 | Chambers | 52/58 |
| 5,669,186 | A | | 9/1997 | Verby et al. | |
| 5,682,713 | A | | 11/1997 | Weiss | |

(Continued)

FOREIGN PATENT DOCUMENTS

DE 36 42 464 7/1988

(Continued)

*Primary Examiner*—Richard E. Chilcot, Jr.
*Assistant Examiner*—Ryan D Kwiecinski
(74) *Attorney, Agent, or Firm*—Merek, Blackmon & Voorhees, LLC

(57) ABSTRACT

The flashing component comprises a rigid flashing frame arrangeable against outer side faces of the main frame component and foldable resilient side flashing members, which can be folded to allow packing of the flashing component together with the window and main frame components into a single unit comprising all components needed for installation of the roof window assembly.

13 Claims, 11 Drawing Sheets

U.S. PATENT DOCUMENTS

| | | | | |
|---|---|---|---|---|
| 5,806,255 | A * | 9/1998 | Verby et al. | 52/200 |
| 5,913,785 | A | 6/1999 | Möller et al. | |
| 6,052,956 | A * | 4/2000 | Hoy et al. | 52/200 |
| 6,195,948 | B1 | 3/2001 | Lamanna | |
| 6,202,373 | B1 | 3/2001 | Lindgren | |
| 6,263,623 | B1 | 7/2001 | Weiss et al. | |
| 6,263,624 | B1 * | 7/2001 | Hoy et al. | 52/200 |
| 6,370,828 | B1 | 4/2002 | Genschorek | |
| 6,640,508 | B2 * | 11/2003 | Lindgren et al. | 52/200 |
| 2002/0095884 | A1 * | 7/2002 | Lindgren et al. | 52/200 |
| 2004/0111981 | A1 * | 6/2004 | Faurholdt et al. | 52/58 |
| 2005/0076583 | A1 * | 4/2005 | Quarles | 52/58 |

FOREIGN PATENT DOCUMENTS

| | | |
|---|---|---|
| WO | WO 93/11332 | 6/1993 |
| WO | WO 94/00655 | 1/1994 |
| WO | WO 95/28535 | 10/1994 |
| WO | WO 98/22682 | 5/1998 |
| WO | WO 98/22684 | 5/1998 |
| WO | WO 98/22685 | 5/1998 |
| WO | WO 98/22686 | 5/1998 |

* cited by examiner

SKY 21

VELUX

The production of SelfFlashed/Fixed.

On the sides of the flashing an EPDM sheets are mounted. 5" at the top - 16" in the bottom. At the edges of the sheets a water stop in aluminum is mounted.

FLASHING COMPONENT FOR A ROOF WINDOW ASSEMBLY

CROSS-REFERENCE TO RELATED APPLICATIONS

The present application is a continuation-in-part of U.S. patent application Ser. No. 09/803,669 filed Mar. 12, 2001 now U.S. Pat. No. 6,640,508 and claims the benefit of priority from Danish patent application No. PA 2001 00105 filed Jan. 19, 2001.

FIELD OF THE INVENTION

The present invention relates to roof window installations and assemblies and components for use therein. In particular, the invention relates to a novel design and structure of a flashing component, which can be used in various types of roof window installations and assemblies and a roof window assembly including such a flashing component.

BACKGROUND OF THE INVENTION

Window assemblies developed and designed particularly for installation in more or less inclined roof surfaces are well known in the art. Among numerous examples disclosed in the art reference could be made e.g. to the roof window assemblies disclosed in U.S. Pat. No. 5,913,785 and published International Patent Applications WO 98/22682, WO 98/22684, WO 98/22685 and WO 98/22686.

In general, such window assemblies include a main frame structure secured to supporting means of the roof structure and a framed window component in connection therewith, either permanently to provide a fixed window or by some kind of pivotal connection to allow turning of the window component with respect to the main frame between a closed position and ventilating positions which may be confined within a specified opening range.

Common main frame structures may be supplied in ready-made form as part of a window assembly in the form of a main frame component to be arranged by so-called deck-mounting against external supporting members of the roof structure around a window opening formed therein.

The main frame structure is frequently made of wood profiles e.g. forming top, side an bottom members of a rectangular frame configuration and covered on externally exposed side faces by flashing members providing weather protection to the wood profiles and securing a tight connection or joint with the roof covering surrounding the window.

Such flashing members are well known in the art and may be supplied in a multitude of different forms, e.g. as a flashing frame made entirely of an elastically deformable material as disclosed in published International Patent Application WO 94/00655.

BRIEF SUMMARY OF THE INVENTION

It is a primary object of the invention to provide a flashing component forming a complete flashing arrangement, that can be easily integrated with the main frame and window components of a roof window assembly to form a single ready-to-install (a single ready to use) assembly including all components and parts needed for the installation of a safe and operational roof window.

A further object of the invention is to provide a roof window assembly with an integrated flashing component offering a wide-going simplification of production useful for production of an overall product program of roof window assemblies of various designs.

According to a first aspect of the invention a flashing component is provided for connection with external surfaces of top, side and bottom faces of a main frame component of a roof window assembly to provide a weather-proof joint of the roof window assembly with a surrounding roof-covering, comprising: a first plurality of flashing members of a substantially rigid material for arrangement against said external top, side and bottom faces, and a second plurality of flashing members of a resiliently foldable material connected with said first plurality of flashing members.

According to a second aspect of the invention a roof window assembly is provided, comprising a substantially rectangular main frame component for stationary connection with supporting means of a roof structure and composed of top, side and bottom members and a substantially rectangular window component with a glazing element engaged along all sides by a window frame, and a flashing component to provide a weather-proof joint of the roof window assembly with a surrounding roof-covering, said flashing component including a first plurality of flashing members of a substantially rigid material for arrangement against said external top, side and bottom faces, and a second plurality of flashing members of a resiliently foldable material connected with said first plurality of flashing members.

Structural and operational details of preferred designs of a flashing component and a roof window assembly embodying the invention and advantages obtained thereby will become apparent from the appended drawings and the detailed description to follow.

DETAILED DESCRIPTION OF THE INVENTION

As shown in FIGS. 1 to 6, the main components of a roof window assembly embodying the invention may comprise a window component 1, a main frame component 2 and a flashing component 3. It is noted that the term "roof window assembly" should be interpreted as embracing any kind of fixed or ventilating skylights.

Figure 1:
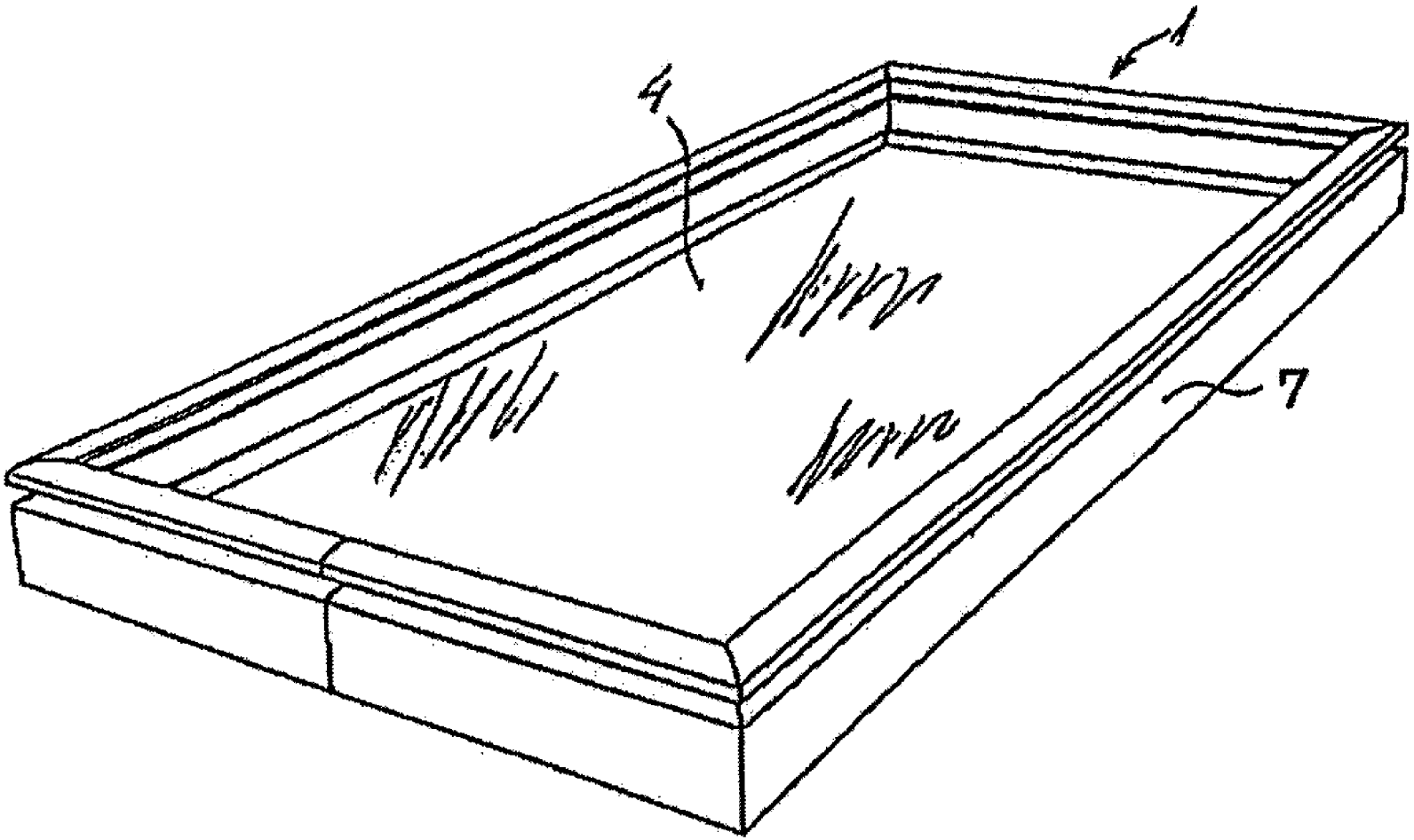
FIGS. 1 to 3 are perspective views of examples of the window and main frame components of a roof window assembly and a first embodiment of a flashing component according to the invention, respectively.

In the illustrated embodiment the window component 1 comprises as shown in FIG. 1 a rectangular insulating glazing element 4 engaged on all sides by a window frame 7 made of sheet metal profile such as aluminum profile of a thickness of e.g. 1.5 mm. This is by no way limiting to the present invention, however, since the frame could alternatively be made from extruded metal or plastic profile material and use of at least the flashing component of the present invention is not limited to any particular form of the window component.

Figure 4:
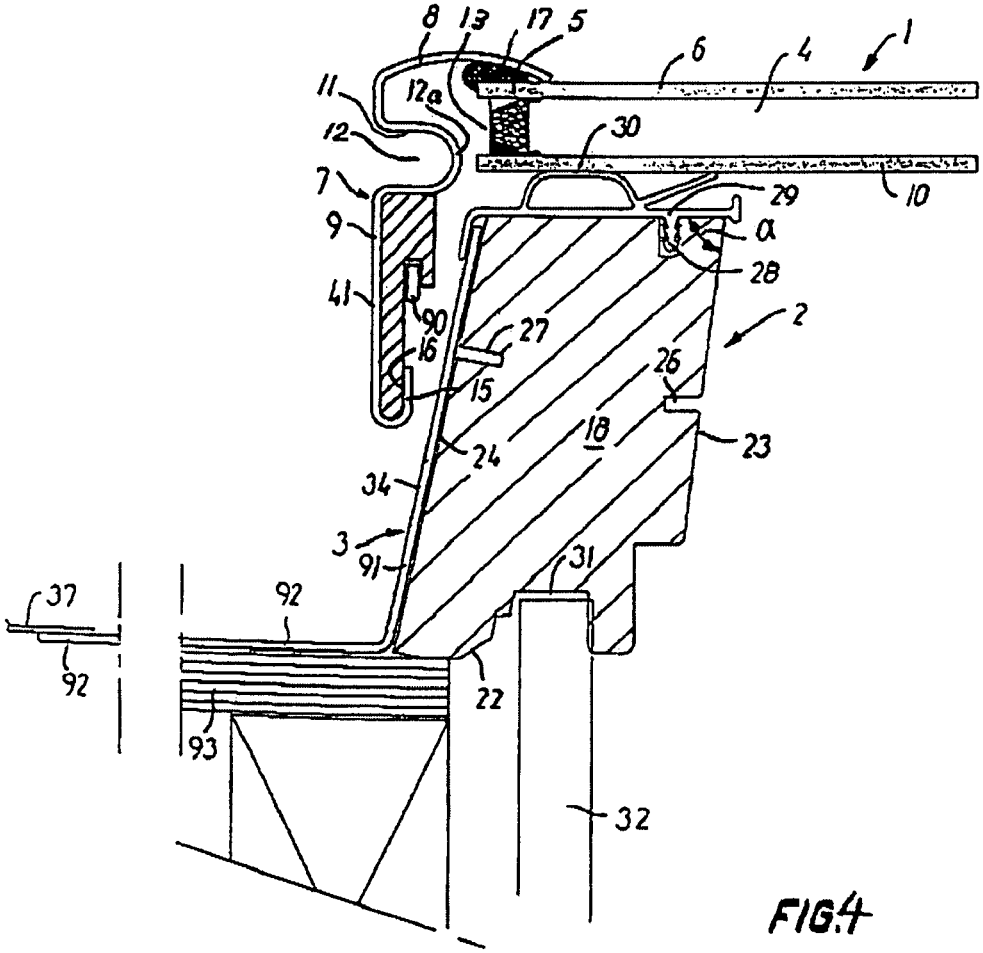
FIGS. 4 to 6 are sectional views, on a larger scale, of an embodiment of the roof window assembly with an integrated flashing component as shown in FIG. 3 intersecting a side member, a top member and a bottom member, respectively, of the main frame component thereof.
Figure 5:
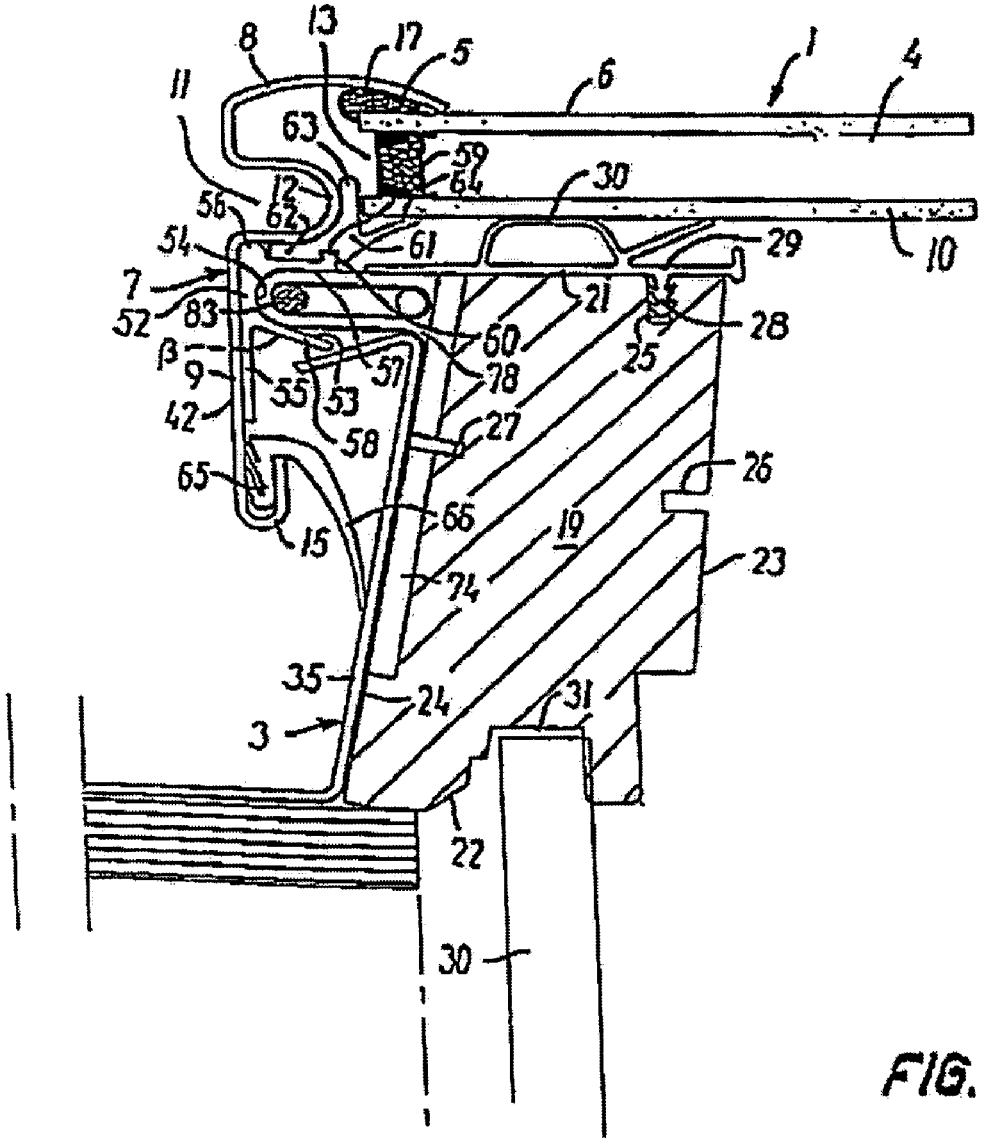
Figure 6:
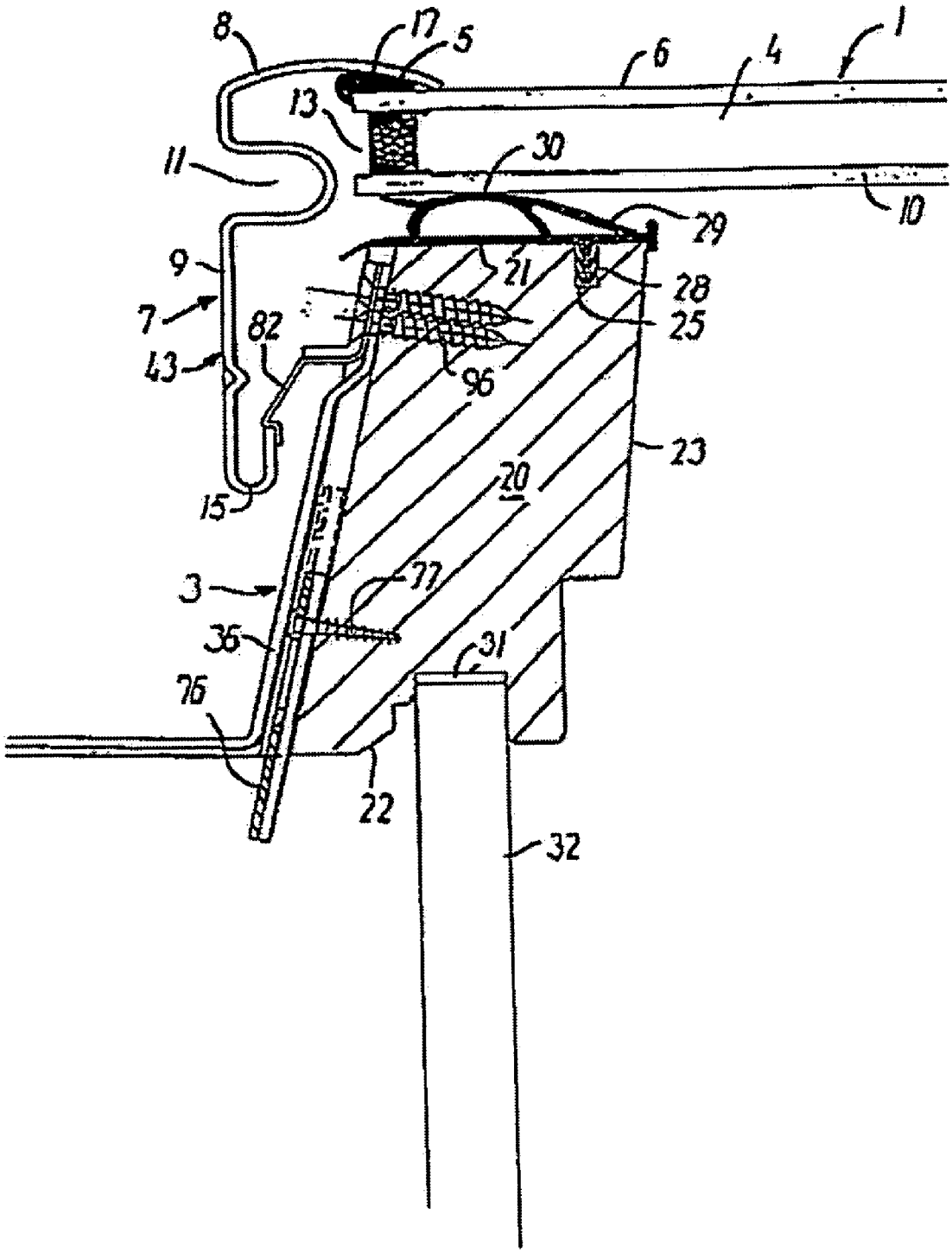

In the illustrated example the window frame 7 is formed, as shown in FIGS. 4 to 6, with the same generally L-shaped cross-section comprising a first profile wall 8 for engagement with the edge zones 5 of the glazing element and a second profile wall 9 extending generally at substantially right angles to the first profile wall 8 and substantially parallel to the perimeter sides of the glazing element 4.

Between its corner junction with the second profile wall 9 and a free edge forming a rest for the glazing element 4 the first profile wall 8 is formed with a shallow through-shaped cross-section, e.g. as illustrated in the form of a substantially part-cylindrical curvature.

At a separation from the first profile wall 8 determined by the thickness of the glazing element 4 between an external major surface 6 and an internal major surface 10 thereof, the second profile wall 9 is formed with a transverse inwards recess 11 provided by a relatively narrow groove-like longitudinal depression 12 having a bottom section 12*a* positioned substantially opposite a side edge 13 of the glazing element 4 with a relatively small clearance 14 thereto.

Along its lower free edge remote from the first profile wall 8 the second profile wall 9 of the window frame 7 is formed with a bent edge flange 15 forming a track 16 extending substantially parallel to the depression 11.

The glazing element 4 is permanently connected with the window frame 7 solely by a strip 17 of an adhesive compound interposed between all edge zones 5 of the glazing element 4 and the trough-shaped first profile wall 8 of the window frame.

Figure 2:
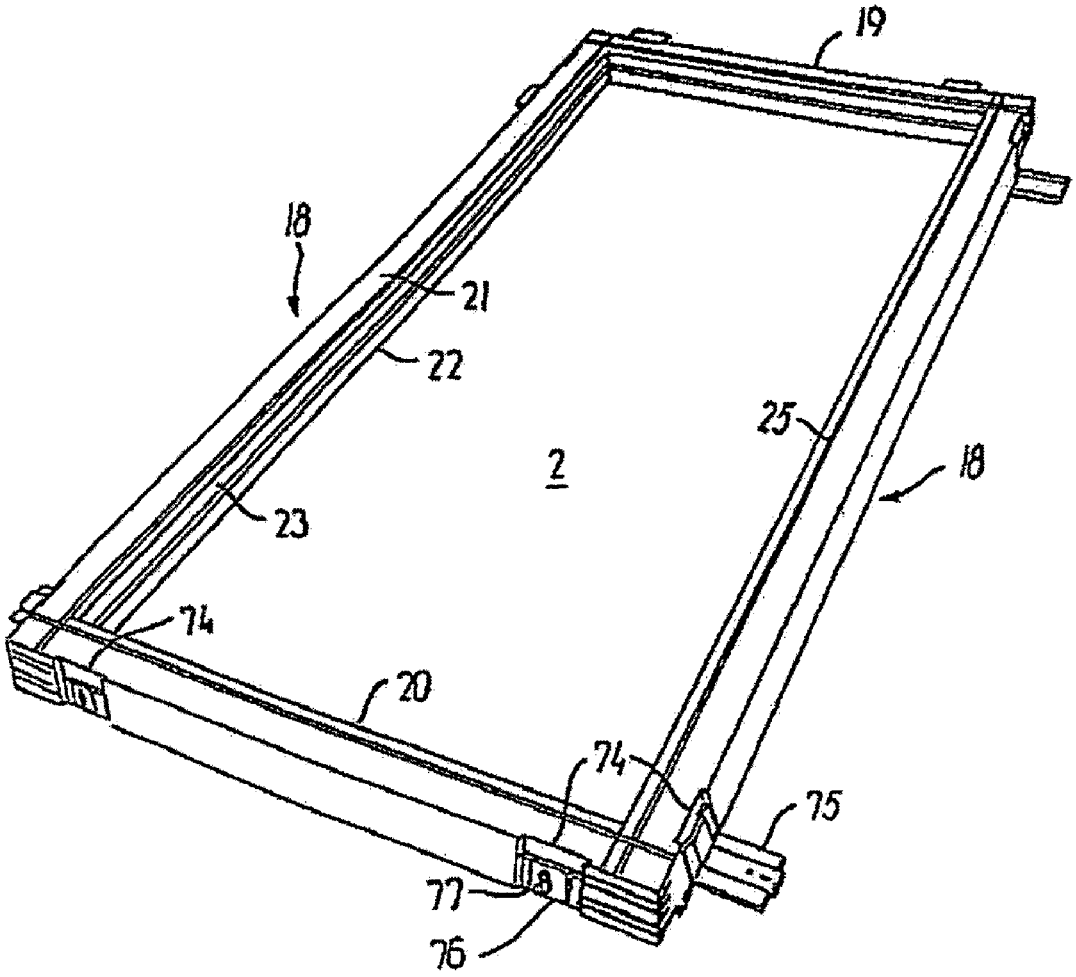

As shown in FIG. 2 the main frame component 2 is generally composed of two side members 18, a top member 19 and a bottom member 20 made of wood profiles. The side, top and bottom members of the main frame component could also be made wholly or in part, however, of metallic profiles or profiles of plastic material.

Figure 9:
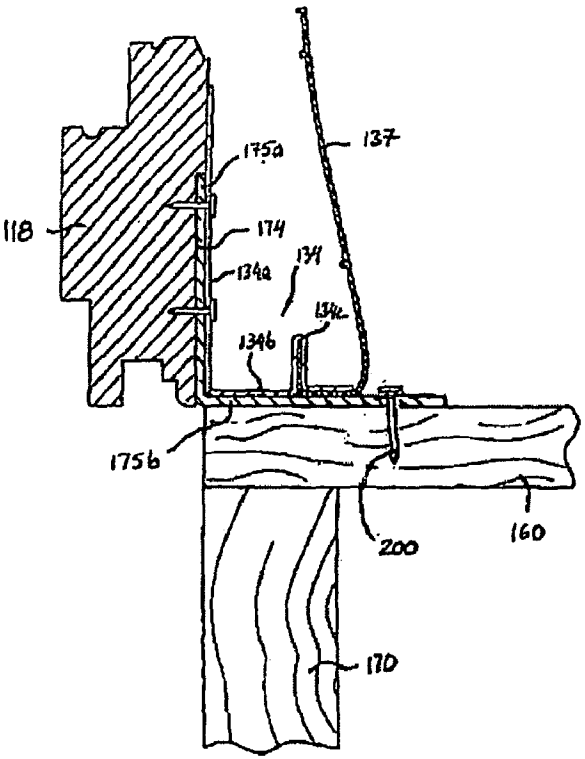
FIG. 9 is a sectional view, on a larger scale, of the roof window assembly of FIG. 8 along the line IX-IX.
Figure 8:
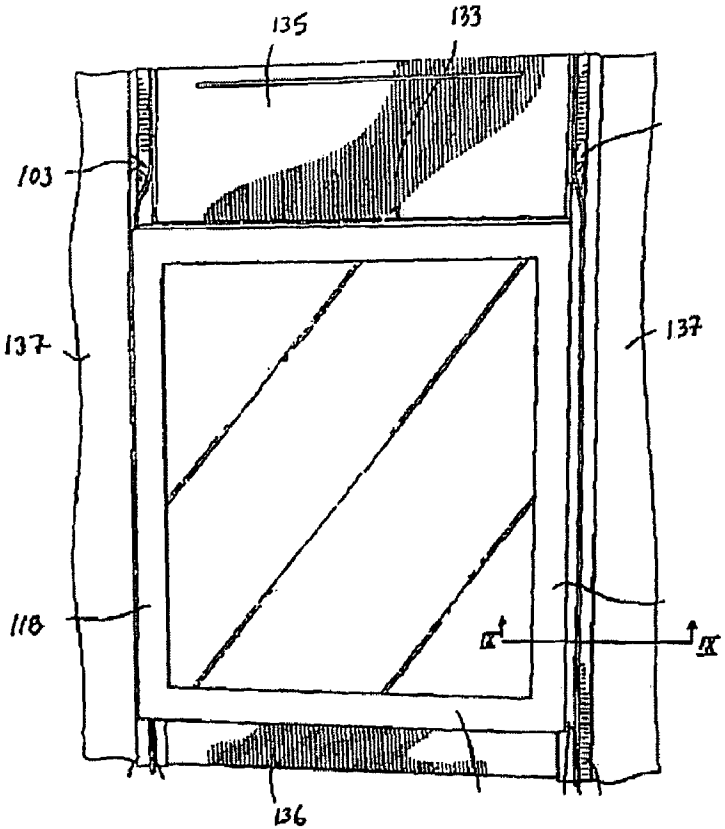
FIG. 8 is a perspective view of a second embodiment of the flashing component according to the invention.

At least for the side and top members 18 and 19 and, for a main frame component for use in a fixed version, i.e. a not openable window assembly, also for the bottom member 20 the main frame profiles have the same cross-sectional shape, generally in the form of a parallelogram as known per se from the above-mentioned prior art references WO 98/22682, WO 98/22685 and WO 98/22686, with a first pair of substantially parallel sides forming upper and lower side faces 21 and 22 of the frame member and a second pair of substantially parallel sides forming inner and outer side faces 23 and 24 and inclined with respect to the first pair of sides 21 and 22 with a minor included angle in the range from 40° to 85°, e.g. a minor included angle of 79°. However, other cross-sectional shapes are, of course, conceivable, e.g. as shown in the embodiment of FIGS. 8 and 9 to be described in the following.

In each of the upper, inner and outer side faces 21, 23 and 24, respectively, of the side, top and bottom members 18 to 20 of the main frame component 2, a relatively narrow longitudinal track 25, 26 and 27, respectively, is formed as shown in FIGS. 4 to 6. In the longitudinal tracks 25 in the upper side faces 21 of the main frame members, which together define a common window plane, a projecting rib part 28 of an elastomeric gasket member 29 interposed between the main frame component 2 and edge zones 30 of the internal major surface 10 of the glazing element 4 of the window member 1 is mounted. The longitudinal tracks 26 and 27 formed in the inner and outer side faces 23 and 24, respectively, may be used for mounting of connecting and mounting members for securing the main frame component with respect to a roof structure. For instance, mounting brackets 75 are secured in depressions 74 in the outer side faces 24 of the side members 18. Temporary positioning members 76 with elongate holes or slits 77 are placed in the depressions 74 of the bottom member.

In the lower side face 22 of each of the side, top and bottom members 18 to 20 of the main frame component, a longitudinal groove 31 may be formed for connection with a lining panel 32 forming part of an internal lining for the window opening, in which the roof window assembly is mounted.

The window and main frame components as illustrated in FIGS. 1 and 2 are described in further detail in applicant's co-pending U.S. patent application Ser. No. 09/803,669, the disclosure of which is incorporated herein by reference.

Figure 3:
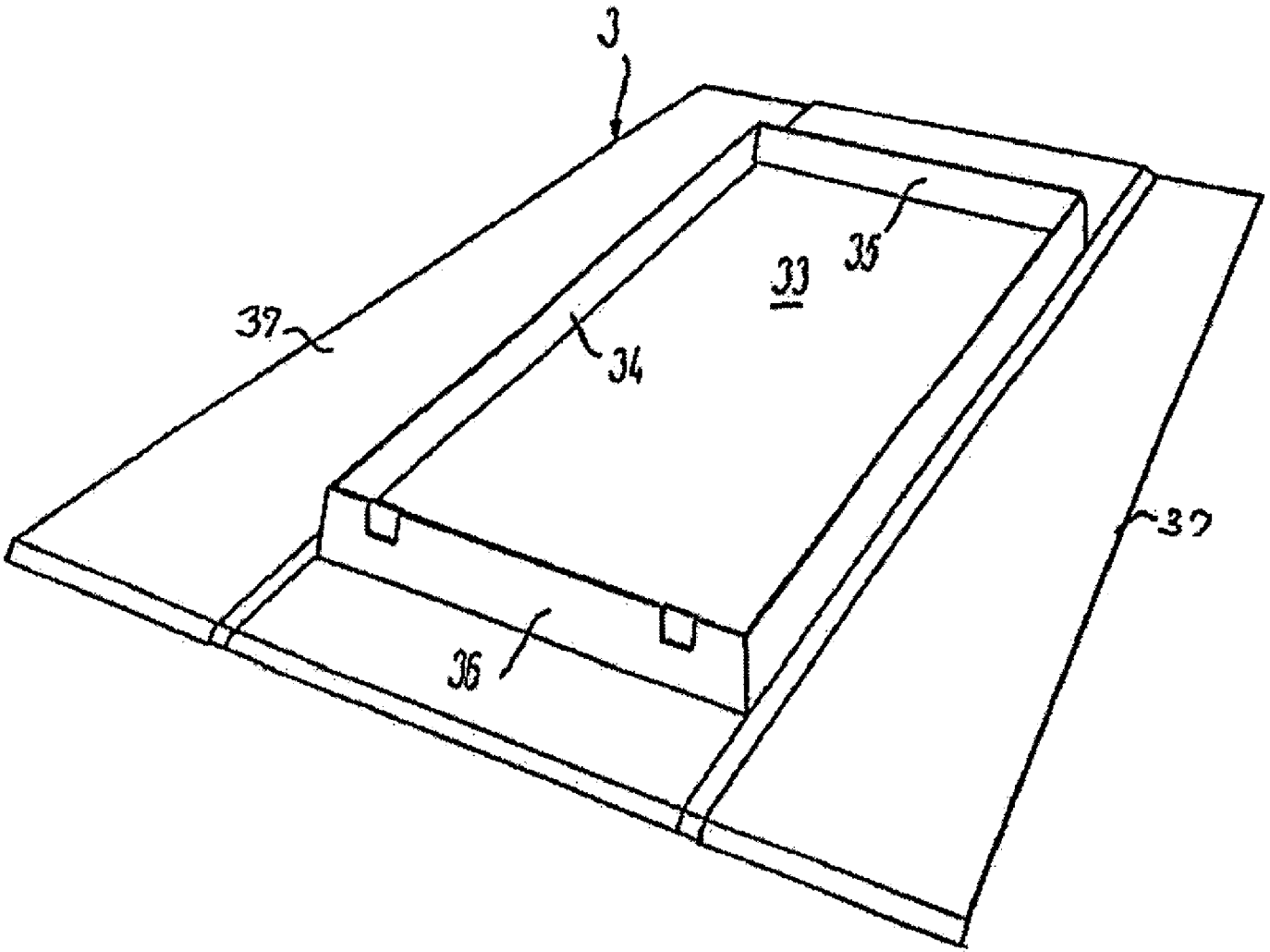

In FIG. 3 a first embodiment of the flashing component 3 is shown, which comprises a rectangular flashing frame 33 of a substantially rigid material, such as aluminum sheet profiles forming interconnected side, top and bottom members 34, 35 and 36, respectively, for arrangement against the side, top and bottom members 18, 19 and 20, respectively, of the main frame component 2, and side flashing sheets 37 of a resiliently foldable material such as an elastomeric material connected with the side members 34 of the flashing frame 33 along the external longitudinal edges thereof.

As shown in the sectional views in FIGS. 4 to 6 the side, top and bottom members 34 to 36 of the rectangular flashing frame 33 of the flashing component 3 are tailored to the outer side faces 24 of the side, top and bottom members 18 to 20 of the main frame component 2. As described in the foregoing the flashing frame is made of a substantially rigid material, e.g. sheet metal, such as aluminum in a thickness of 1.5 mm, with the side, top and bottom members 18 to 20 interconnected by welding such as laser welding or any other suitable connection method.

As best seen in FIG. 4 the side members 34 of the flashing frame 33 are generally L-shaped with a part 91 engaging the outer side face 24 of the side member 18 of the main frame component 2 and a part 92 resting on the roof covering 93 immediately surrounding the window assembly and extending below the side flashing sheet 37, which is made of a resiliently foldable material, e.g. an elastomeric material.

The connection between the flashing frame part 92 and the side flashing sheet 37 may be provided in any suitable manner, e.g. by welding, gluing, the provision of a form-locking engagement such as foldings, which may be upstanding or substantially parallel to the plane of the flashing frame part 92 and the side flashing sheet 37, or any combination of the above techniques.

As a result of the combination of the substantially rigid flashing frame 33 with the foldable resilient side flashing sheets 37 the flashing component 3 offers the advantageous integration of the flashing component 3 with the window and main frame components 1 and 2 of the window assembly into a single ready to use package including all components and parts needed for the installation of a safe and operational roof window.

Figure 7:
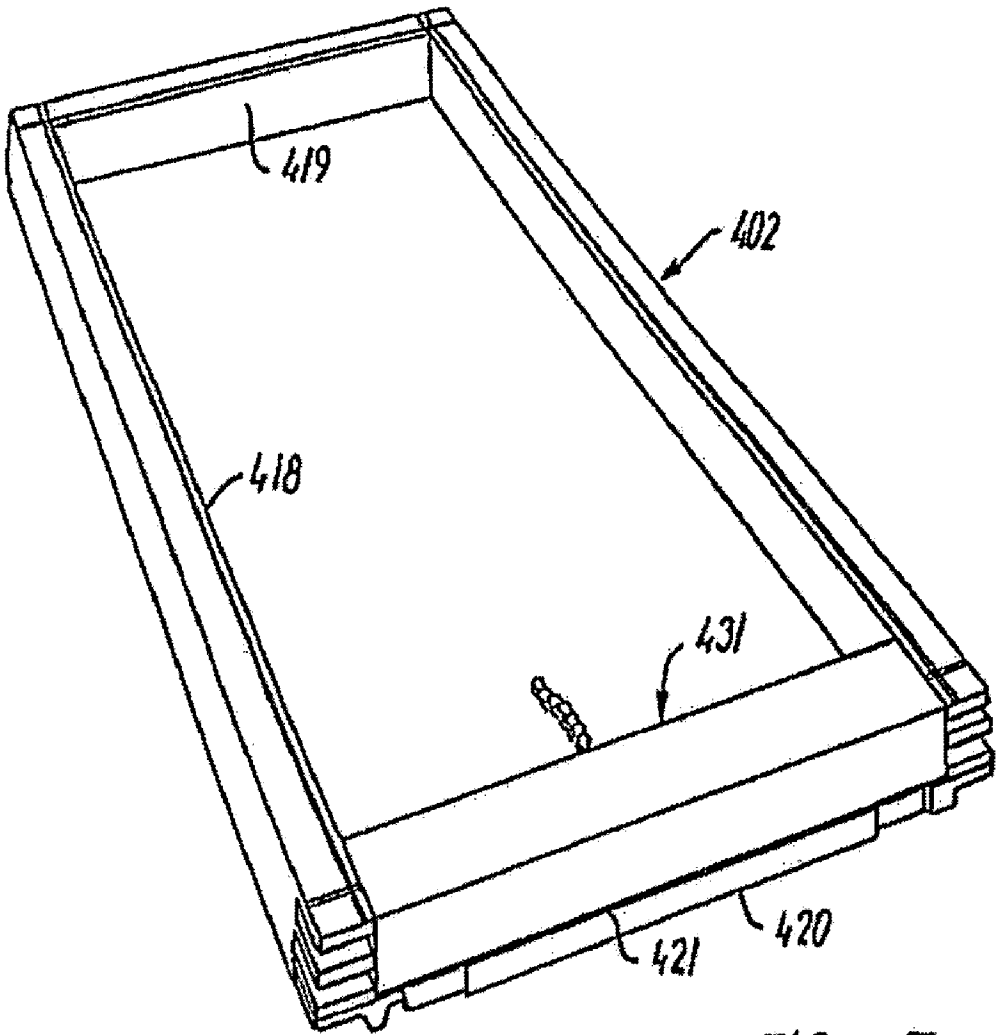
FIG. 7 is a perspective view of a modification of the main frame component shown in FIG. 2.

As shown in the perspective view in FIG. 7 electrical operation of the window component 1 in a ventilating version of the window assembly may be provided for by use of a slightly modified main frame component 402 having a bottom member 420, the upper side face 421 of which is retracted from the common window plane defined by the upper side faces of the side and top members 418 and 419 of the main frame component to leave a space between the common window plane and the upper side face 421 of the bottom member 420 for arrangement of a housing 431 of an electric window operator of a type known per se, e.g. a chain operator having an elongate opening member in form of a chain 432 with an end part 433 for connection with the side of the window component (not shown) opposite the bottom member 420. Such an electrical window operator may be adjusted to operate the window component between its closed position with respect to main frame component and any ventilating position within a range of positions defined by hinge joints formed by pairs of connecting members 52 and 78 at the top side of the window assembly as shown in FIG. 5. To provide for dismounting of the window component the end part 433 of the operator chain 432 may be releasably connected with the window component in a manner known per se.

In the second embodiment of the flashing component shown in FIGS. 8 and 9, a flashing component 103 comprises a rigid flashing frame 133 composed of a first plurality of flashing profiles, of which the right-hand side member 134 is shown in detail in FIG. 9. The flashing component 103 includes a similar component at the left-hand side member and furthermore rigid flashing profiles 135 and 136 at the top and bottom, respectively, of the window.

The cross-sectional view of FIG. 9, in which the window frame is not shown for reasons of clarity, shows one mounting bracket 175 of a number of, e.g. two, mounting brackets fastened to the main frame side member 118. Each mounting bracket 175 is mounted on the side member in such a manner that a first leg 175*a* is received in a depression 174 of the main frame side member 118. A second leg 175*b* of the mounting bracket 175 rests on a sheathing 160, which in turn rests on a rafter 170. A mounting nail 200 is inserted into through openings (not shown in detail) in the second leg 175*b* of the mounting bracket 175 and is driven into the sheathing 160. The L-shaped flashing profile 134 of the flashing component extends along at least the length of the side member 118. A first wall portion or leg 134*a* is positioned in abutment with the outer side face of the main frame side member 118 and thus overlaps the first leg 175*a* of the mounting bracket 175. A second wall part or leg 134*b* of the flashing profile 134 is positioned on top of the second leg 175*b* of the mounting bracket 175 and comprises a folded portion 134*c* which together with the first leg 134*a* forms a channel for transporting e.g. water along the side member 118 of the main frame. A second plurality of flashing members is connected with the first plurality of flashing members, here represented by a flexible skirt 137 of a resiliently foldable material, e.g. rubber, which is by one side edge accommodated in the raised folded portion 134*c*. A similar skirt is connected with the rigid flashing member at the opposite side member of the window. The flexible skirt 137 extends at least along the side member 118 and preferably further up above the window and further down below the window as indicated in FIG. 8. During mounting of the window, the skirt 137 is lifted as indicated in FIG. 9, following which the mounting means may be inserted through the openings of the second leg of each mounting bracket 175. When mounting means have been driven into the underlying roof supporting structure, the flexible skirt 137 is released and brought to a position in which it overlaps the part of the second leg 175*b* of the mounting bracket 175 that was made visible when the resiliently folded material was brought into a lifted position. Subsequently, a roofing such as shingles may be put on top of the flexible skirt 137. The roofing may end at a suitable distance from the raised folded portion 134*c* and may be sealed with respect to the flexible skirt and/or the rigid side flashing member.

As a result of the combination of the substantially rigid flashing frame 133 with the foldable resilient side flashing sheets 137, and the mounting brackets 175, this embodiment offers the advantageous integration of the flashing component 103 and mounting brackets with the window and main frame components of the window assembly into a single ready-to-use package including all components and parts needed for the installation of a safe and operational roof window.

Figure 10:
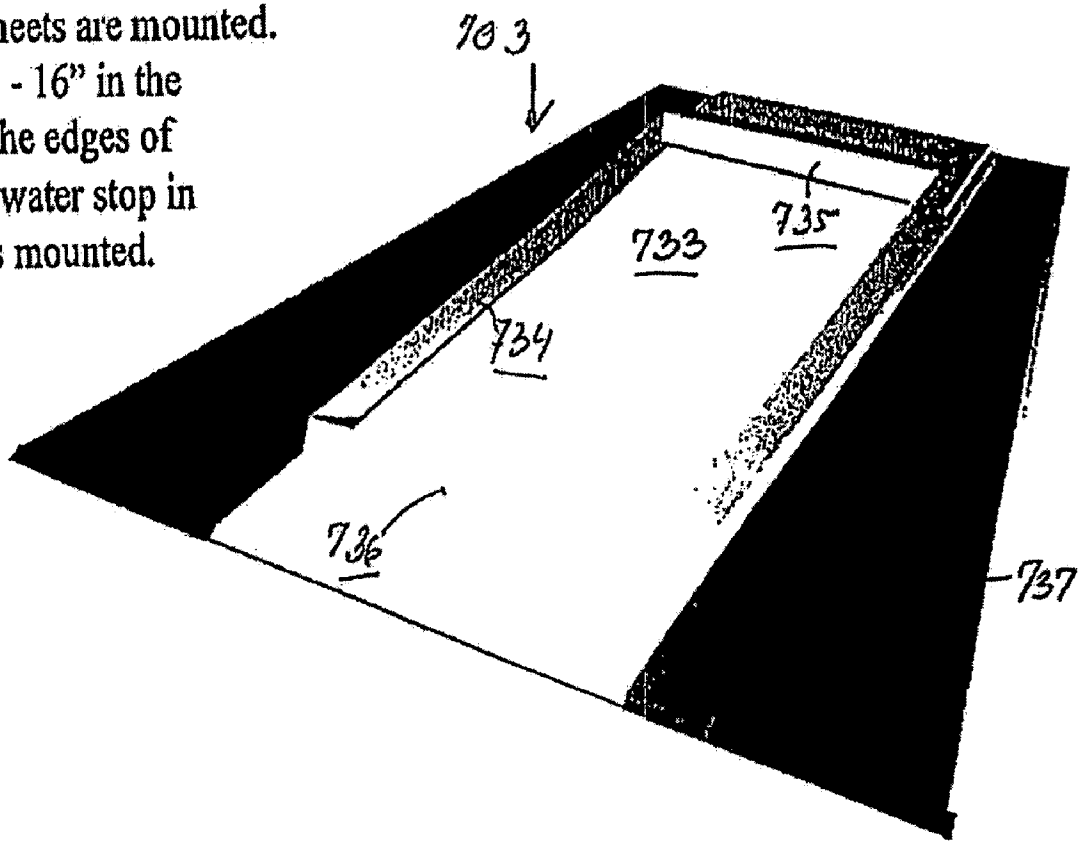
FIG. 10 is a perspective view of a third embodiment of the flashing component.

As shown in the perspective view of the third embodiment of the flashing component in FIG. 10 the foldable flashing sheet members 737 may be formed in a triangular or delta-like shape with a width increasing in the direction from the top member 735 towards the bottom member 736 of the flashing frame 733. The flashing frame 733 may be designed as in the embodiment of FIGS. 1-6 or 8-9. Thereby, the ability of the flashing component to prevent water flowing down the inclined roof surface from penetrating into the roof stricture underlying the flashing component may be considerably improved.

Figure 11:
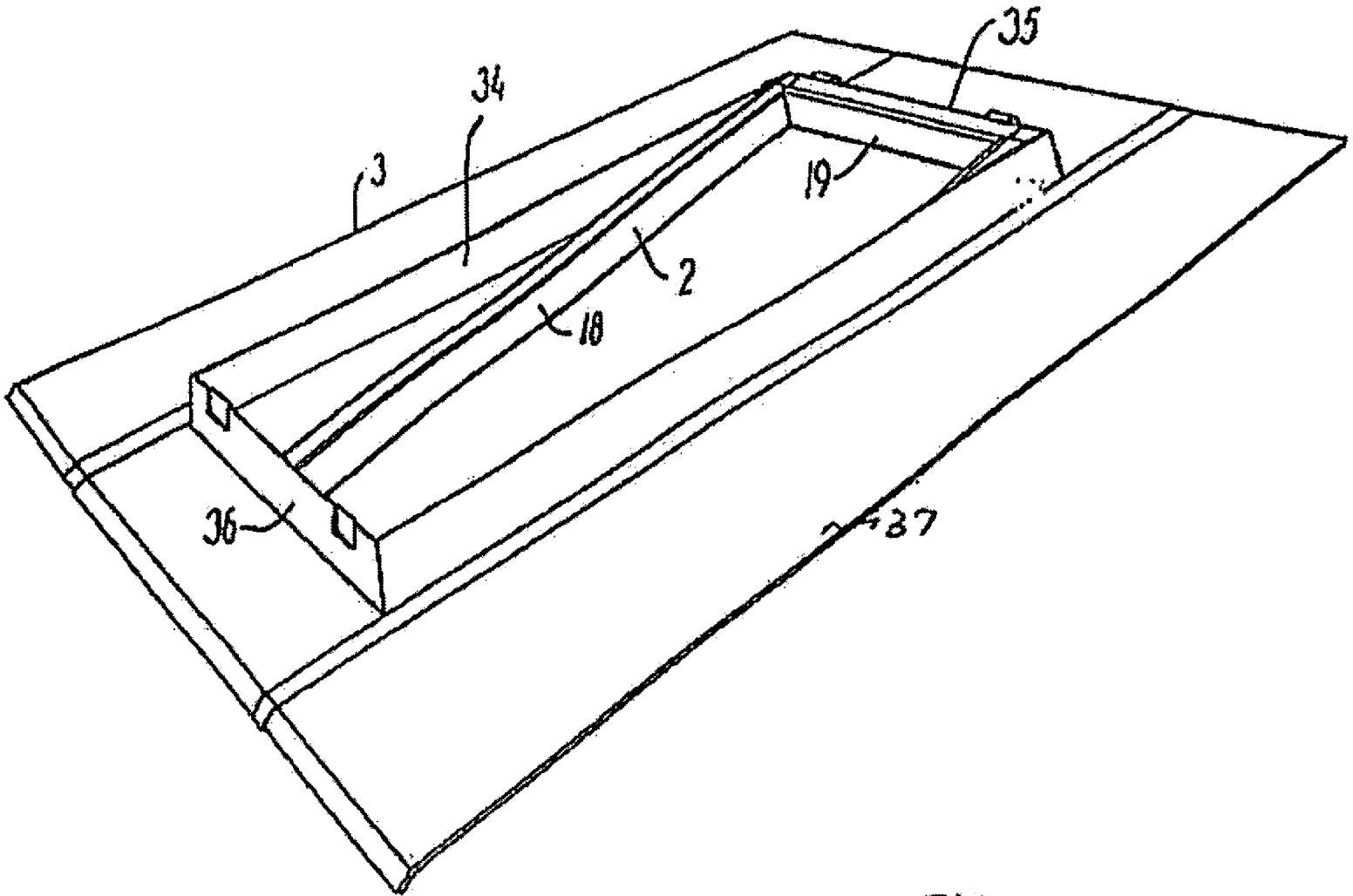
FIGS. 11 and 12 are perspective views of the assembling of the main frame, flashing and window components of a roof window assembly according to the invention.
Figure 12:
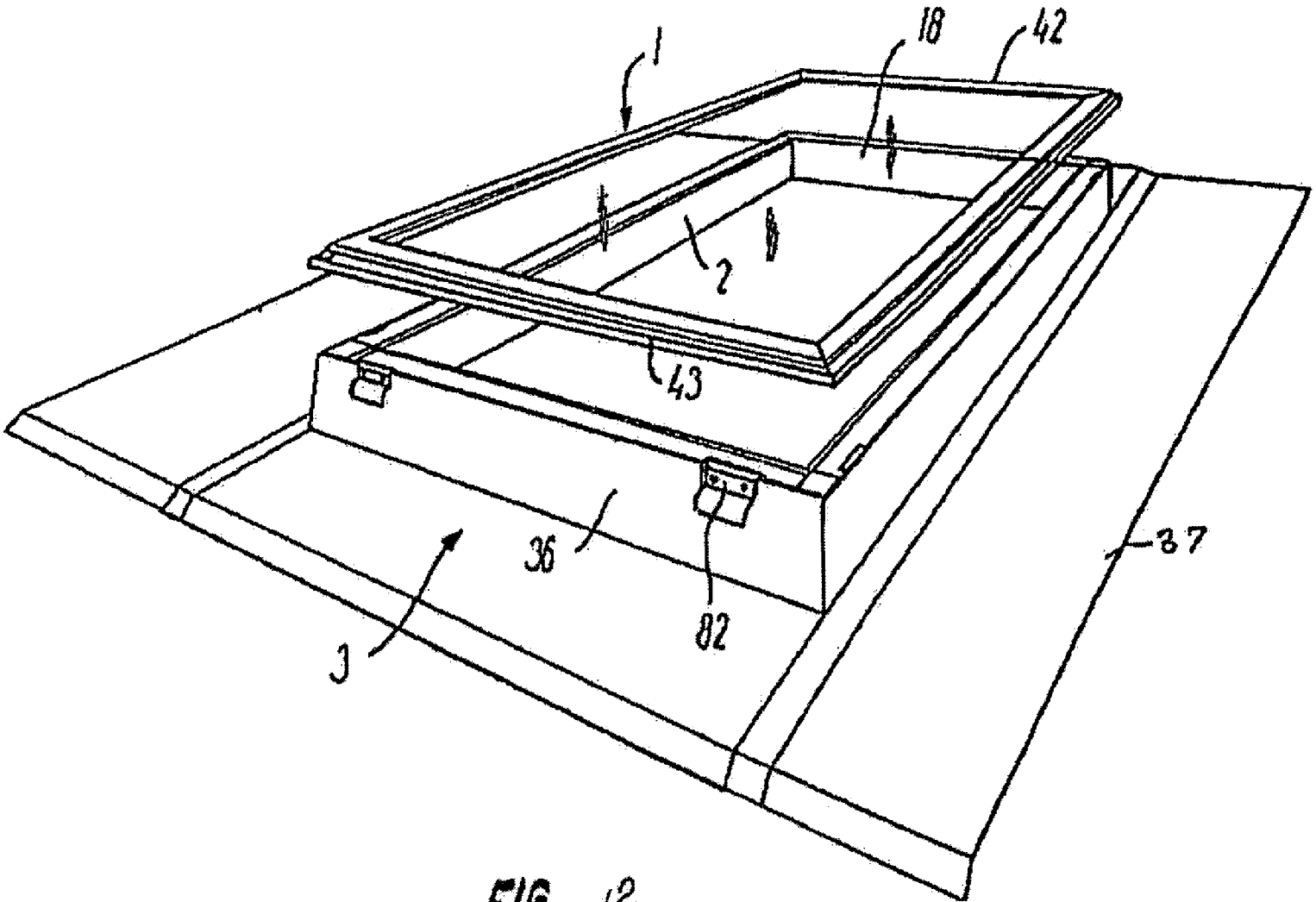

For the embodiments of the flashing component illustrated in FIGS. 1 to 6, 8 to 9, and 10 comparatively easy installation of a roof window assembly may be accomplished as shown in the schematic perspective views in FIGS. 11 and 12. As shown in FIG. 11, installation of the window assembly in a window opening, which has been formed through the roof structure of an inclined roof, starts with mounting of the main frame component 2, which in the manner described in the foregoing is secured to supporting means such as a sheathing or rafters of the roof structure by means of the angular mounting brackets 75 secured in the depressions 74 in outer side faces 24 of the side members 18 as shown in FIG. 2.

Subsequently, after securing of connection members to the top and bottom members 19 and 20 of the main frame component 2 the flashing component 3 can be easily hooked onto the main frame component 2 by bringing the top member 35 of the flashing frame 33 into contact with the outer side face 24 of the top member 19 of the main frame component 2 and pushing the flashing frame 3 into place with its side and bottom members 34 and 36 arranged against the outer side faces 24 of the side and bottom members 18 and 20 of the main frame component 2.

As the last step in the installation procedure the window component 1 may now, as illustrated in FIG. 12, be hooked onto the main frame component 2 by engaging the connecting members 52 secured to the top side 42 of the window component with the connecting members 78 secured in the depressions 74 of the outer side face 24 of the top member 19 of the main frame component 2.

If a fixed version of the window assembly is to be installed the window component is subsequently simply clicked into place with a bent edge flange 15 at the bottom side 43 of the window component 1 engaging clip-like locking members 82 secured in advance to the outer side face 24 of the bottom member 20 of the main frame component 2 as shown in FIG. 6.

If a ventilating window is to be installed a torsion spring may be connected with the connecting member 78 by insertion of its retaining part into a longitudinal channel formed in the engagement part of the connecting member 78 and the retainer block 90 must be connected with the second profile wall 9 of the window frame 7 in an appropriate position in the upper part of each lateral side 41 of the window component 1. After the window component has been hooked onto the main frame component 2 in the manner described a hook end 89 of the torsion spring is brought into engagement with the retainer block 90, and, if electrical operation of the window component is envisaged, the end member 433 of an elongate operator member such as a chain 432 is connected with the bottom side 43 of the window component 1.

The invention should not be regarded as being limited to the embodiments described in the above but various modifications and combinations of the shown embodiments may be carried out without departing from the scope of the following claims.

The invention claimed is:

1. A flashing component for connection with external surfaces of top, side and bottom faces of a main frame component of a roof window assembly to provide a weather-proof joint of the roof window assembly with a surrounding roof-covering, comprising: four interconnected sides defined by a first plurality of flashing members of a substantially rigid material for arrangement against said external top, side and bottom faces, said four sides together defining an opening through the flashing component, wherein said opening is adapted to receive said main frame component of a roof window assembly and wherein two of said four sides are longer than the other two sides, and a flashing member of a resiliently foldable material connected with each of the flashing members of a substantially rigid material that define the two longer sides, no flashing member of a resiliently foldable material being connected with either of the flashing members of a substantially rigid material that define said other two sides.

2. A flashing component as claimed in claim 1, wherein said first plurality of flashing members form a flashing frame including two side members, and wherein the side members of the flashing frame are of a generally L-shaped cross-section comprising a first wall part for connection with said external side face of the main frame component and a second wall part for connection with a respective flashing member of a resiliently foldable material.

3. A flashing component as claimed in claim 2, wherein said second wall part of the side members of said flashing frame is formed with an upwardly projecting folded portion extending in parallel with said first wall part to define a water channel along a side of said roof window assembly.

4. A flashing component as claimed in claim 3, wherein an edge of a respective flashing member of said second plurality is accommodated in the upwardly projecting folded portion.

5. A flashing component as claimed in claim 2, wherein the flashing members of a resiliently foldable material are triangular with a width increasing in the direction from the top member to the bottom member of the flashing frame.

6. A roof window assembly comprising a substantially rectangular main frame component for stationary connection with supporting means of a roof structure and composed of top, side and bottom members and a substantially rectangular window component with a glazing element engaged along all sides by a window frame, and a flashing component to provide a weather-proof joint of the roof window assembly with a surrounding roof-covering, said flashing component including four interconnected sides defined by a first plurality of flashing members of a substantially rigid material for arrangement against said external top, side and bottom faces, said four sides together defining an opening through the flashing component, wherein said opening receives said main frame component of a roof window assembly and wherein two of said four sides are longer than the other two sides and a flashing member of a resiliently foldable material connected with each of the flashing members of a substantially rigid material that define the two longer sides, no flashing member of a resiliently foldable material being connected with either of the flashing members of a substantially rigid material that define said other two sides.

7. A roof window assembly as claimed in claim 6, wherein said first plurality of flashing members form a flashing frame including two side members, and wherein the side members of the flashing frame are of a generally L-shaped cross-section comprising a first wall part for connection with said external side face of the main frame component and a second wall part for connection with a respective flashing member of a resiliently foldable material.

8. A roof window assembly as claimed in claim 7, wherein said second wall part of the side members of said flashing frame is formed with an upwardly projecting folded portion extending in parallel with said first wall part to define a water channel along a side of said roof window assembly.

9. A flashing component as claimed in claim 8, wherein an edge of a respective flashing member of a resiliently foldable material is accommodated in the upwardly projecting folded portion.

10. A roof window assembly as claimed in claim 7, wherein the flashing members of a resiliently foldable material are triangular with a width increasing in the direction from the top member to the bottom member of the flashing frame.

11. A roof window assembly comprising: a substantially rectangular main frame component for stationary connection with supporting means of a roof structure and composed of top, side and bottom members and a substantially rectangular window component with a glazing element engaged along all sides by a window frame, a flashing component to provide a weather-proof joint of the roof window assembly with a surrounding roof-covering, said flashing component including four interconnected sides defined by a first plurality of flashing members of a substantially rigid material for arrangement against said external top, side and bottom faces, said four sides together defining an opening through the flashing component, wherein said opening receives said main frame component of a roof window assembly and wherein two of said four sides are longer than the other two sides, and a flashing member of a resiliently foldable material connected with each of the flashing members of a substantially rigid material that define the two longer sides, no flashing member of a resiliently foldable material being connected with either of the flashing members of a substantially rigid material that define said other two sides, and a number of mounting brackets fastened to at least the side members of the main frame component.

12. A roof window assembly as claimed in claim 11, wherein each mounting bracket comprises a first leg fastened to one of the side members of the main frame and a second leg resting on a sheathing of the roof structure.

13. A roof window assembly as claimed in claim 12, wherein at least one opening for a mounting means is provided in the second leg of each mounting bracket at a position covered by a respective flashing member of resiliently foldable material.

* * * * *